US005451971A

United States Patent [19]

Grossman et al.

[11] Patent Number: 5,451,971

[45] Date of Patent: Sep. 19, 1995

[54] COMBINED J-POLE AND TRANSMISSION LINE ANTENNA

[75] Inventors: Ovadia Grossman, Ramat Gan; Avi Tooba, Rishon Lezion, both of Israel

[73] Assignee: Motorola, Inc., Schaumburg, Ill.

[21] Appl. No.: 90,720

[22] Filed: Jul. 13, 1993

[51] Int. Cl.[6] ..... H01Q 21/24

[52] U.S. Cl. ..... 343/828; 343/825

[58] Field of Search ..... 343/825, 826, 828, 702, 343/795, 905; H01Q 21/24, 1/38

[56] References Cited

U.S. PATENT DOCUMENTS 2,124,424 7/1938 Leeds ..... 343/825

4,259,673 3/1981 Guretzky ..... 343/825

4,644,364 2/1987 Parks ..... 343/825

*Primary Examiner*—Michael C. Wimer

*Attorney, Agent, or Firm*—Charles W. Bethards

[57] ABSTRACT

An antenna is provided comprising first (11), second (12) and third (13) line elements dispersed on first, second and third consecutive sides of a rectangle (10). The third line element is longer than the first line element by a length approximately equal to the length of the second line element, thereby providing a radiating portion of the third line element. A feed connector (14) is coupled to the first and third line elements, for applying a radio frequency signal to the antenna for radiating from the second line element and from the radiating portion of the third line element.

6 Claims, 1 Drawing Sheet

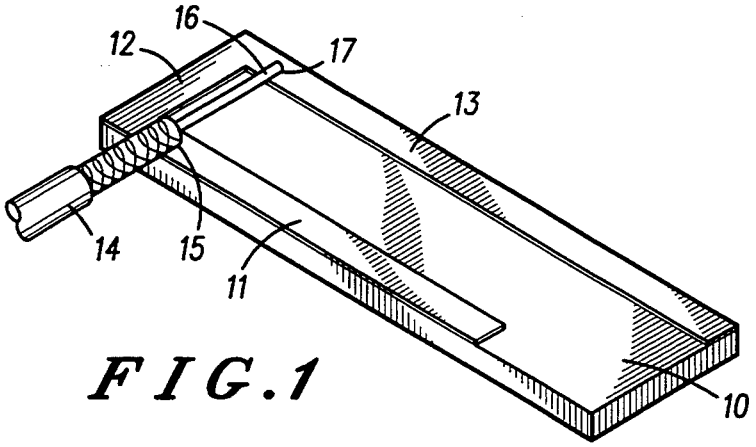
FIG. 1
FIG. 2
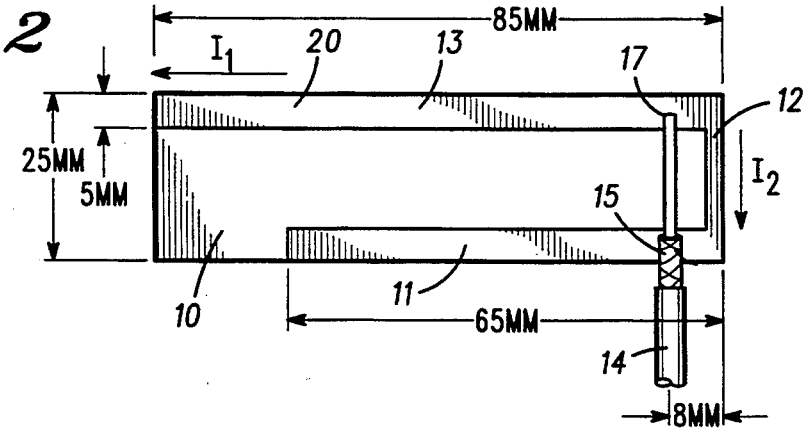
FIG. 3
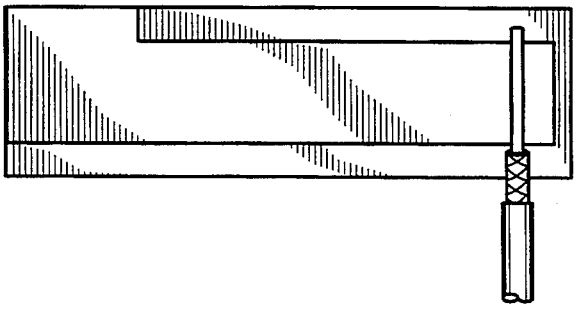
FIG. 5
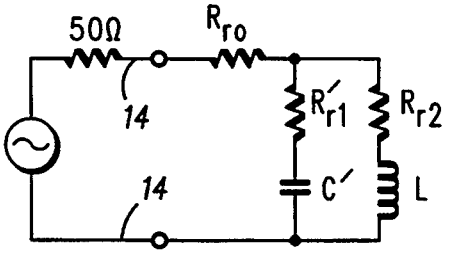
FIG. 4
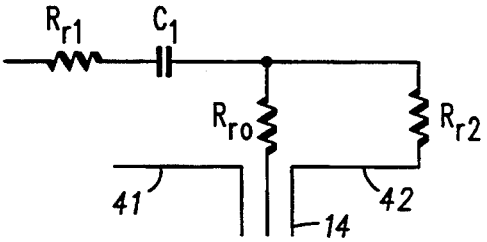
FIG. 6
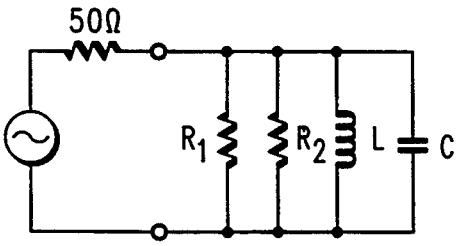

COMBINED J-POLE AND TRANSMISSION LINE ANTENNA

FIELD OF THE INVENTION

This invention relates to an antenna, such as for use in a data radio transceiver.

BACKGROUND OF THE INVENTION

There exists in the United States data radio systems capable of two-way data communication in the 806–870 MHz frequency band. There is a need for small, highly portable data transceivers to operate on this system. Such transceivers are to transmit in the 806–825 MHz range and receive in the 851–870 MHz range.

Various known antenna types potentially suitable for such a device are as follows:

1. transmission line antenna—PC board or otherwise
2. Capacitively loaded "Bent" antenna
3. Resistively loaded antenna
4. "Full wave" bent wire antenna
5. PC board "full wave" antenna.

Antennas 1 to 3 and 4, 5 comprise two different classes of antennas.

The first three antenna types constitute the high Q and smaller bandwidth antennas. These antennas can be made as small as necessary, with the subsequent deterioration in the efficiency of the antenna in proportion with it's dimensions (5%–50% efficiencies). These antennas are relatively non-sensitive to their surroundings but change their specification drastically with a change in the "close field" surroundings (in the region of 0.02 λ).

These are basically low gain low efficiency antennas. They have one clearly defined polarization and do not exhibit polarization diversity qualities.

Because these are "self-contained" antennas, they are well suited for the case where the antenna designer is not familiar with the immediate surroundings of the antenna (radio covers, logic board, batteries), and can safely assume that the antenna can be developed independently and then trimmed to the specific enclosure.

Antenna types 4 and 5 are "full wave" antennas, i.e. their radiation resistances are comparatively large (about 50 ohms), thus their efficiencies are usually better than 90%. However, depending on the specific design, their near fields are quite large in volume and are affected by nearby metal objects (this closeness also reduces somewhat their efficiencies). However it is possible to trim those antennas to the specific surroundings. The polarization is usually mixed.

There is need for a very compact and efficient antenna to be employed as a built-in antenna. There is also a need for an antenna that radiates in two different orthogonal planes, so that the device can receive and transmit in any position in which it is orientated.

SUMMARY OF THE INVENTION

According to the present invention, an antenna is provided comprising: first, second and third line elements disposed in a J-shaped configuration so as to be dispersed on first, second and third consecutive sides of a rectangle, each line element having first and seconds ends, the first end of the first element being connected to the first end of the second element and the second end of the second element being connected to the first end of the third element, the third line element being longer than the first line element by a length approximately equal to the length of the second line element, thereby providing a radiating portion of the third line element. Feed connection means are coupled to the first and third line elements near their first ends, for applying a radio frequency signal to the antenna for radiating from the second line element and from the radiating portion of the third line element.

The antenna of the invention has the advantage that the radiating part of the third line element is perpendicular to the second line element and these elements radiate (and receive) in orthogonal planes.

The antenna is efficient, providing a low Q resonator design. It can be favourably compared to microstrip, "bent F" or patch antennas.

The antenna has a broad bandwidth. It can be tuned to 50 ohm lines, with a 15–20% bandwidth, which is much more than similar types of printed circuit board antennas.

The antenna is a combination of a transmission line antenna and a J-pole antenna. These are preferably formed on a single printed circuit board, using one feed line. The different parts of the antenna are selected for even power division between the two parts of the antenna.

BRIEF DESCRIPTION OF THE DRAWINGS

FIG. 1 shows a stereoscopic view of the preferred embodiment of the invention.

FIG. 2 shows a plan view of an antenna similar to that of FIG. 1.

FIG. 3 shows a plan view of a further embodiment similar to that of FIG. 1.

FIGS. 4, 5 and 6 are equivalent electrical circuits for the antenna of FIG. 2.

DETAILED DESCRIPTION OF THE PREFERRED EMBODIMENT

Referring to FIG. 1, an antenna is shown comprising a printed circuit board 10 having first second and third printed copper tracks (or "line elements") 11, 12 and 13 deposited on the upper surface thereof. The dimensions of the printed circuit board 10 are 85 mm×25 mm. The printed circuit could be as small as 30 mm×18 mm. A coaxial cable 14 has an outer sheath connected at a feed connection point 15 on the first line element 11 and has an inner conductor 16 connected to a feed point 17 on the line element 13.

FIG. 2 shows the same antenna in mirror image. copper track 11 is 65 mm in length, copper track 12 is 25 mm in length and copper track 13 is 85 mm in length. Track 13 has a width of 5 mm. The coaxial cable 14 is connected to copper track 11 at a position 8 mm from the end of that track where the copper track joins copper track 12. Line element 13 is 20 mm longer than line element 11. This approximately corresponds to the length of line element 12. Thus, portion 20 of line element 13 is a radiating portion. Line elements 11 and 13 act as a transmission line element. Currents I1 and I2 flow in radiation portion 20 of line element 13 and in line element 12 respectively. The feed points 15 and 17 of coaxial cable 14 are located 8 mm from the ends of line elements 11 and 13 respectively adjacent line element 12.

FIG. 3 shows the same antenna as FIG. 2, but with the first and third line elements interchanged. That is to say the outer sheath of the coaxial cable is connected to the longer of the two elements and the inner core is connected to the shorter of them.

The following explanation addresses FIG. 2, but the explanation is the same for FIG. 3.

The antenna is a hybrid between a transmission line antenna (I2—radiating current) and a "J pole" antenna (radiating current I1). The currents are perpendicular to each other and create an elliptical polarization.

In order to describe the principle of operation, a schematic capture and equivalent lumped element model are shown in FIGS. 4,5 and 6.

In FIG. 4, $R_r$ is the radiation resistance of the different elements. The two transmission line sections 41 and 42—that is to say the parts of transmission line 11 on either side of the connection point 15 transform the radiating sections to the feed point as shown in FIG. 5. In FIG. 5, $R_{ro}$ is negligible as compared to the $R_{r1}$ and $R_{r2}$ values, because they are inside a resonator L-C with high circulating currents.

The power is distributed between the two equivalent radiation resistances R1 and R2 of the two antennas. The overall length of the transmission line is $\lambda/4$, where $\lambda$ is the approximate wavelength of the signal to be received or transmitted and the parallel combination of R1 and R2 is designed to be 50 ohms to match the source of the signals to be transmitted.

The phase difference between the two antennas can be readily calculated by comparing the transmission line length to both antennas. Actual designs show figures of approximately $\lambda/6$, i.e. 60° phase difference, thus creating effective elliptical polarization. Using different permeability substrates can result in effective circular polarization antennas, with their phase centers very close together, thus providing efficient solutions to polarization diversity requirements.

The coaxial cable and radio cover can also play a part in this antenna and create some radiation with polarization in the third dimensional axis. Actually some current "runs away" on the shield of the coaxial cable (because of the nonsymmetry of the antenna and imperfect balancing of currents by the transmission line). This current represents small overall antenna gain loss (approximately 1 dB) and has some influence on the impedance of the antenna. This current can be controlled and brought to the required level by an additional coaxial loop and additional reactance (choke) that reduces this current's value.

We claim:

1. An antenna comprising:

first, second and third line elements disposed in a J-shaped configuration, each line element having first and seconds ends, the first end of the first element being connected to the first end of the second element and the second end of the second element being connected to the first end of the third element, the third line element being longer than the first line element by a length approximately equal to the length of the second line element, thereby providing a radiating portion of the third line element, and feed connection means coupled to the first and third line elements near their first ends, for applying a radio frequency signal to the antenna for radiating from the second line element and from the radiating portion of the third line element, where the antenna has an equivalent circuit comprising an inductor and capacitor in parallel forming a resonator circuit, with the second line element and the radiating portion of the third line element being located within the resonator circuit, whereby the second line element radiates approximately equally to the radiating portion of the third line element, giving the antenna an effective elliptical polarization.

2. An antenna according to claim 1, wherein the feed connection means is a coaxial cable.

3. An antenna according to claim 2, wherein the coaxial cable comprises an inner conductor connected to one of the first and third line elements and an outer conductor connected to the other of the first and third line elements.

4. An antenna according to claim 1, wherein the third line element has a length approximately equal to one quarter of the wavelength of the signal applied to the feed connection means.

5. An antenna for radiating a radio frequency signal of a given wavelength, comprising:

first, second and third line elements disposed adjacent three sides of a rectangular printed circuit board in a J-shaped configuration, each line element having first and seconds ends, the first end of the first element being connected to the first end of the second element and the second end of the second element being connected to the first end of the third element, the third line element being longer than the first line element by a length approximately equal to the length of the second line element and approximately equal to one quarter of the given wavelength, and a feed connector coupled to the first and third line elements near their first ends, for applying the radio frequency signal to the antenna, where a portion of the first line element between the feed connector and the first end of the first line element and the second line element and a portion of the third element between the first end of the third line element and the feed connector together form an inductive loop, and parallel portions of the first line element between the feed connection and the second end of the first line element and the third line element between the feed connection and the second end of the third line element together form a capacitor and the inductive loop and the capacitor in parallel form a resonator circuit which resonates at the given wavelength.

6. An antenna comprising:

first, second and third line elements disposed adjacent three sides of a rectangular printed circuit board in a J-shaped configuration, each line element having first and seconds ends, the first end of the first element being connected to the first end of the second element and the second end of the second element being connected to the first end of the third element, the third line element being longer than the first line element by a length approximately equal to the length of the second line element, thereby providing a radiating portion of the third line element, and a feed connector coupled to the first and third line elements near their first ends, for applying a radio frequency signal of a given wavelength to the antenna for radiating from the second line element and from the radiating portion of the third line element, where the antenna has an equivalent circuit comprising an inductor and capacitor in parallel forming a resonator circuit which resonates at the given wavelength, with the second line element and the radiating portion of the third line element being located within the resonator circuit.

* * * * *